US011332957B2

(12) United States Patent
Binek et al.

(10) Patent No.: US 11,332,957 B2
(45) Date of Patent: May 17, 2022

(54) LINKED LOCKING MODULE

(71) Applicant: Carrier Corporation, Jupiter, FL (US)

(72) Inventors: Lawrence Binek, Glastonbury, CT (US); Joseph Zacchio, Wethersfield, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 282 days.

(21) Appl. No.: 16/490,377

(22) PCT Filed: Feb. 28, 2018

(86) PCT No.: PCT/US2018/020255
§ 371 (c)(1),
(2) Date: Aug. 30, 2019

(87) PCT Pub. No.: WO2018/160715
PCT Pub. Date: Sep. 7, 2018

(65) Prior Publication Data

US 2020/0071955 A1 Mar. 5, 2020

Related U.S. Application Data

(60) Provisional application No. 62/465,435, filed on Mar. 1, 2017.

(51) Int. Cl.
*E05B 19/00* (2006.01)
*E05B 47/00* (2006.01)
(Continued)

(52) U.S. Cl.
CPC ..... *E05B 19/0005* (2013.01); *E05B 47/0001* (2013.01); *E05B 67/02* (2013.01); *E05B 67/06* (2013.01)

(58) Field of Classification Search
CPC .. E05B 19/0005; E05B 47/0001; E05B 67/02; E05B 67/06
(Continued)

(56) References Cited

U.S. PATENT DOCUMENTS 1,875,768 A 9/1932 Smith
4,702,095 A 10/1987 Ben-Asher
(Continued)

FOREIGN PATENT DOCUMENTS

EP 2372068 A2 10/2011

OTHER PUBLICATIONS

International Search Report for International Application No. PCT/US2018/020255, International Filing Date Feb. 28, 2018, dated May 30, 2018, 7 pages.
(Continued)

*Primary Examiner* — Suzanne L Barrett
(74) *Attorney, Agent, or Firm* — Cantor Colburn LLP

(57) ABSTRACT

A locking module (40) for selectively coupling a first component and a second component of a lockable device (20) includes a locking member (42) rotatable between an unlocked position and a locked position and an engagement member (50) associated with said locking member (42). Translation of said engagement member (50) drives movement of said locking member (42) between said locked position and said unlocked position to selectively decouple said first component from the second component.

18 Claims, 3 Drawing Sheets

(51) Int. Cl.
*E05B 67/02* (2006.01)
*E05B 67/06* (2006.01)

(58) Field of Classification Search
USPC ..... 70/52, 63
See application file for complete search history.

(56) References Cited

U.S. PATENT DOCUMENTS

| | | | | |
|---|---|---|---|---|
| 4,808,993 | A * | 2/1989 | Clark | G07C 9/00722 340/5.65 |
| 5,245,652 | A * | 9/1993 | Larson | G07C 9/21 379/102.06 |
| 7,086,258 | B2 * | 8/2006 | Fisher | E05B 19/0005 70/24 |
| 2003/0179075 | A1 * | 9/2003 | Greenman | G07C 9/00896 340/5.54 |
| 2005/0206499 | A1 | 9/2005 | Fisher | |
| 2008/0066506 | A1 | 3/2008 | Carbajal et al. | |
| 2019/0234113 | A1 * | 8/2019 | Neau | E05B 17/002 |
| 2020/0002973 | A1 * | 1/2020 | Hill | E05B 47/004 |
| 2020/0312067 | A1 * | 10/2020 | Fisher | E05B 47/0012 |

OTHER PUBLICATIONS

Written Opinion for International Application No. PCT/US2018/020255, International Filing Date Feb. 28, 2018, dated May 30, 2018, 9 pages.

* cited by examiner

LINKED LOCKING MODULE

CROSS REFERENCE TO RELATED APPLICATIONS

This application is a National Stage application of PCT/US2018/020255, filed Feb. 28, 2018, which claims the benefit of U.S. Provisional Application No. 62/465,435, filed Mar. 1, 2017, both of which are incorporated by reference in their entirety herein.

BACKGROUND

This disclosure relates generally to a lockable device and, more particularly, to a locking module for use in a lockable device.

Lockboxes typically provide a secured storage area for a key or other access aid at a location close to a locked property accessible by the key. In this way, an authorized user can unlock the lockbox to gain access to the secured storage area and then use the key contained therein to unlock the locked property.

The lockbox is typically attached to a door handle or to another stationary object near the traditional lock. The lockbox typically requires the user to demonstrate that he is authorized to obtain access to the locked property before the secured storage area is unlocked to allow the user to obtain the key. In a mechanical lockbox, the user might be required to enter a correct lock combination to access the secured storage area. In an electronic lockbox, the user might be required to communicate a credential to lockbox (via a physical connection to the lockbox or via a wireless link to the lockbox) to access the secured storage area.

SUMMARY

According to one embodiment, a locking module for selectively coupling a first component and a second component of a lockable device includes a locking member rotatable between an unlocked position and a locked position and an engagement member associated with said locking member. Translation of said engagement member drives movement of said locking member between said locked position and said unlocked position to selectively decouple said locking element from the second component.

In addition to one or more of the features described above, or as an alternative, in further embodiments the locking member further comprises a feature formed therein, the feature being receivable within an opening of the second component when the locking member is in the unlocked position.

In addition to one or more of the features described above, or as an alternative, in further embodiments said feature is received within said opening via a clearance fit when said locking member is in said unlocked position.

In addition to one or more of the features described above, or as an alternative, in further embodiments said feature is not receivable within said opening when said locking member is in said locked position.

In addition to one or more of the features described above, or as an alternative, in further embodiments said locking member is mounted within said second component.

In addition to one or more of the features described above, or as an alternative, in further embodiments said engagement member includes one or more protrusions pinned to a portion of said locking member.

In addition to one or more of the features described above, or as an alternative, in further embodiments said locking member is rotated 90 degrees about said axis between said unlocked positon and said locked position.

In addition to one or more of the features described above, or as an alternative, in further embodiments comprising a mechanism associated with said engagement member, said mechanism being configured to translate said engagement member within a plane.

In addition to one or more of the features described above, or as an alternative, in further embodiments comprising a drive plate configured to apply a force to said engagement member and a biasing member associated with said drive plate, said biasing member being configured to bias the drive plate away from the engagement member.

In addition to one or more of the features described above, or as an alternative, in further embodiments said mechanism is a mechanical mechanism that operates the locking member in response to a user input.

In addition to one or more of the features described above, or as an alternative, in further embodiments said engagement mechanism is an electromechanical mechanism that operates the locking member in response to a user input.

In addition to one or more of the features described above, or as an alternative, in further embodiments the locking module is applied to a lockbox such that first component is a body of the lockbox and the second component is a keybox.

In addition to one or more of the features described above, or as an alternative, in further embodiments the locking module is applied to a lockbox such that first component is body of the lockbox and the second component is a shackle.

According to another embodiment, a method of operating a locking module of a lockable device includes operating a mechanism in response to a user input, translating an engagement member within a plane, and rotating a locking member coupled to said engagement member about an axis of rotation between a first position and a second position, said locking member including a feature selectively receivable within an opening of a movable component of the lockable device.

In addition to one or more of the features described above, or as an alternative, in further embodiments said feature is receivable within said opening when said locking member is in said second position.

In addition to one or more of the features described above, or as an alternative, in further embodiments said feature has a contour complementary to said opening when said locking member is in said second position.

In addition to one or more of the features described above, or as an alternative, in further embodiments said feature is not receivable within said opening when said locking member is in said first position.

In addition to one or more of the features described above, or as an alternative, in further embodiments comprising rotating said locking member about said axis between said second position and said first position to selectively couple said movable component to the lockable device.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Figure 1A:
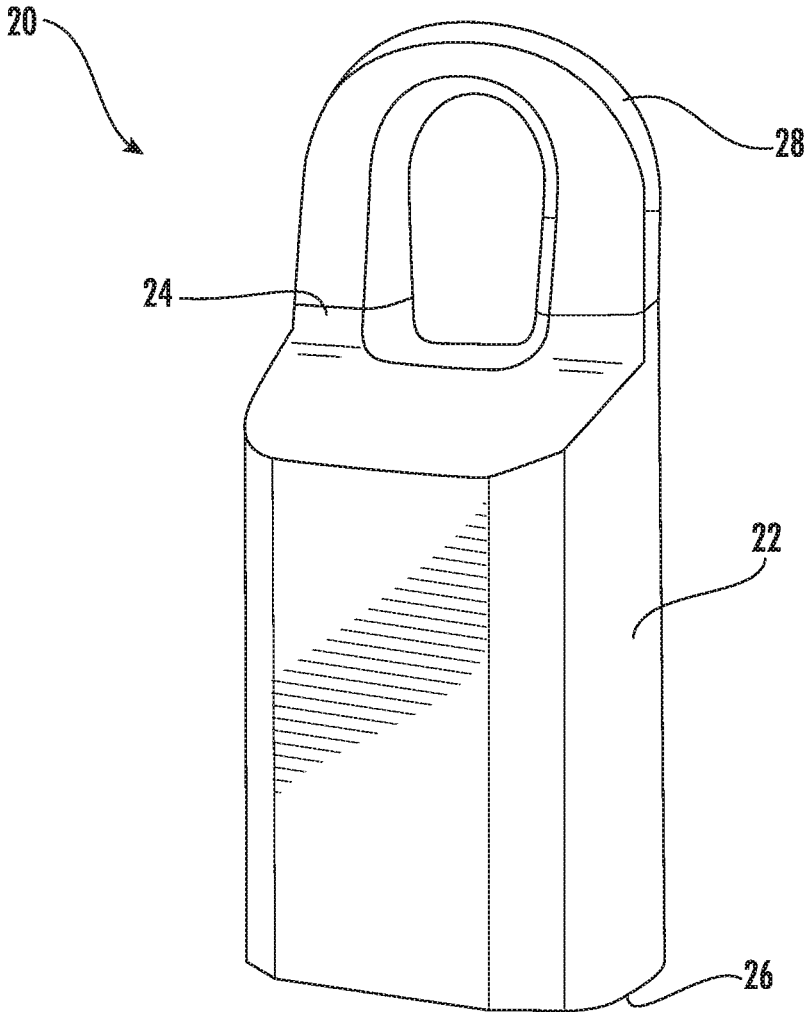
FIG. 1A is a perspective view of an example of a lockable device in a closed configuration.
Figure 1B:
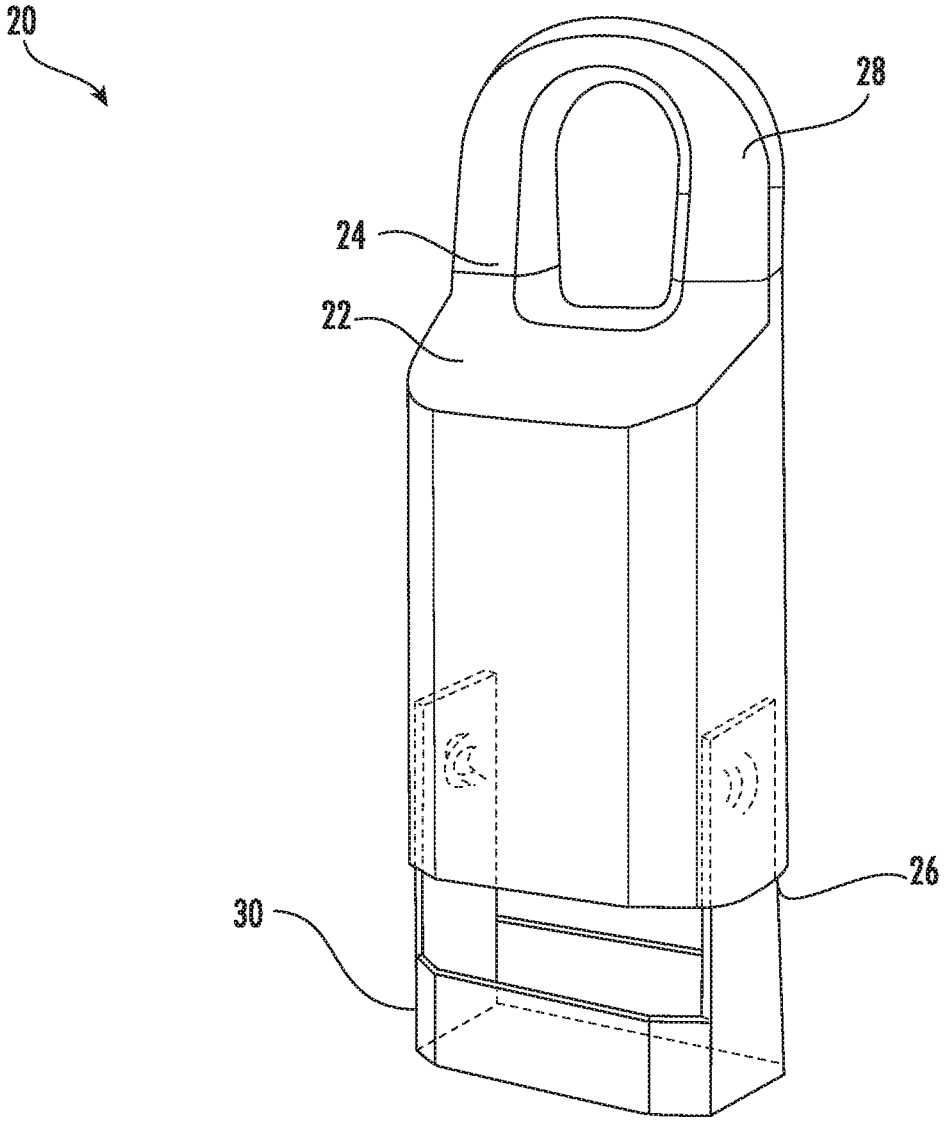
FIG. 1B is a perspective view of an example of a lockable device having a keybox in an extended position.

Referring now to FIGS. 1A and 1B, an example of a lockable device 20, such as a lockbox is illustrated. The lockbox 20 includes a body 22 and one or more components movable relative to the body 22. For example, the lockbox 20 additionally includes a shackle 28 positioned adjacent a first end 24 of the body 22 and a keybox 30 (best shown in FIG. 1B) positioned adjacent a second, opposite end 26 of the body 22. The shackle 28 may be configured to translate and/or rotate relative to the body 22. Alternatively, or in addition, the keybox 30 may be configured to translate relative to the body 22. In an embodiment, at least one of the shackle 28 and the keybox 30 is separable from the body 22.

A locking module 40 (see FIG. 2) is operable to selectively couple a first component and a second component. In an embodiment, when applied to a lockable device, such as lockbox 20 for example, the locking module 40 selectively locks the shackle 28 to the body 22. Accordingly, the locking module 40 restricts movement of the lockbox 20 once arranged in a desired location via the shackle 28. Alternatively or in addition, the locking module 40 may be used to selectively lock the keybox 30 to the body 22. In such instances, operation of the locking module 40 may provide an authorized user with access to the internal cavity of the keybox 30, within which one or more items, such as a key for example, may be stored.

Figure 2:
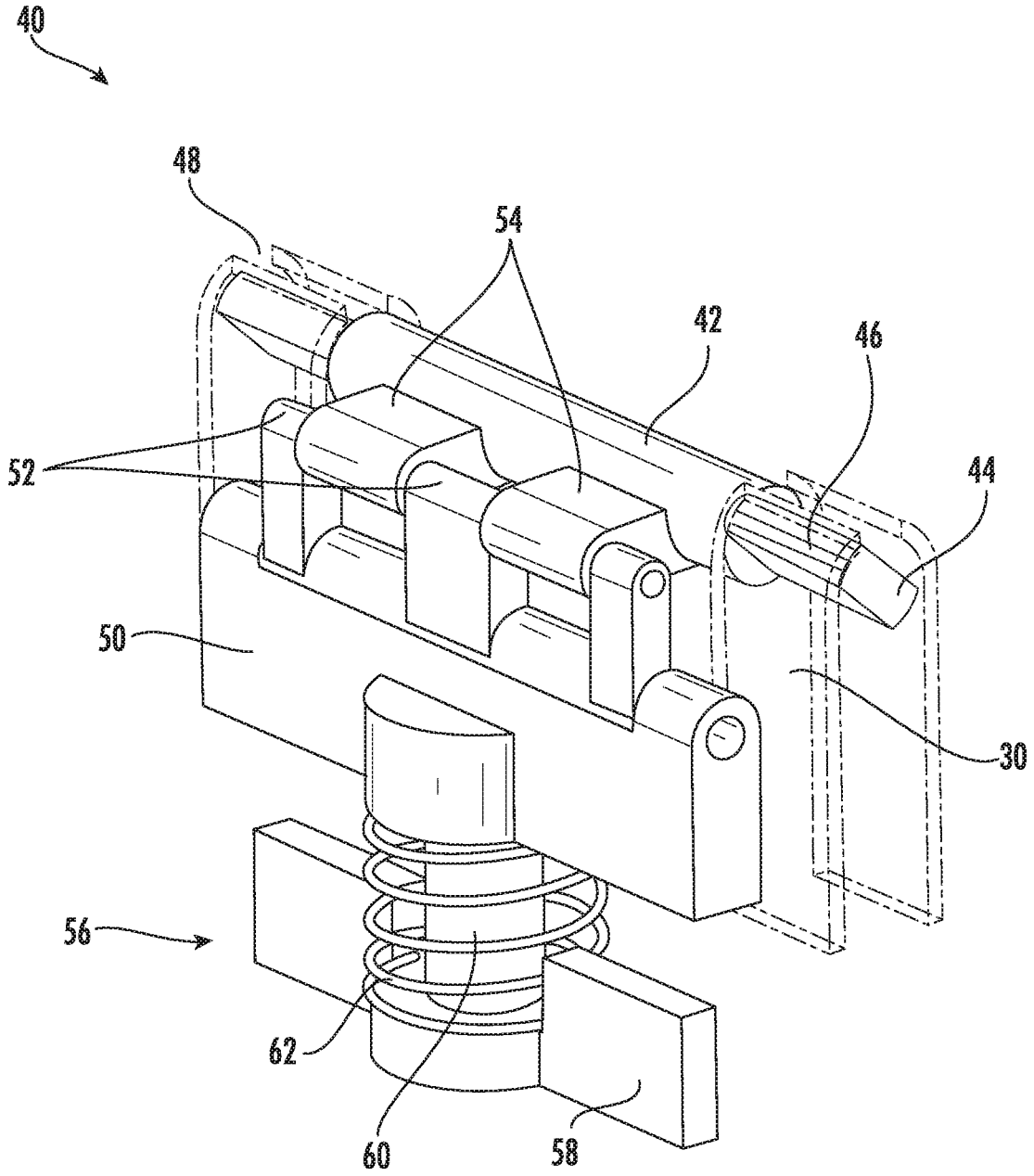
FIG. 2 is a perspective view of a locking module of the lockable device in a locked configuration according to an embodiment.

With reference now to FIG. 2, a locking module 40 configured to selectively couple the keybox 30 to the body 22 of a lockbox 20 is illustrated in more detail. As shown, the locking module 40 includes a locking member 42 rotatably supported within the interior of the body 22 of the lockbox 20. At least one end 44 of the locking member 42 includes a feature 46 arranged adjacent an opening 48 formed in the keybox 30. In the illustrated, non-limiting embodiment, both opposing ends 44 of the locking member 42 includes two substantially identical features configured to selectively engage opposing sides of the keybox 30. However, embodiments where the locking member 42 engages only a first side of the keybox 30 are also contemplated herein.

The contour of the feature 46 is selected such that when locking member 42, and therefore the feature 46, is in a first locked position, the feature 46 is not receivable within the opening 48. However, when the locking member 42 and feature 46 is in a second unlocked position, the feature 46 is receivable within the opening 48, such as via a clearance fit for example. As a result, when the locking member 42 is in the second, unlocked position, the keybox 30 is movable relative to the locking member 42 and the body 22. In the illustrated, non-limiting embodiment, the feature 46 is generally rectangular in shape and has a greater width than thickness. In the locked position, the width of the feature 46 exceeds the size of the opening 48, thereby restricting movement of the keybox 30 relative to the locking member 42. In the unlocked position, however, the feature 46 is oriented generally vertically such that the thickness of the feature 46 is smaller than the size of the opening 48. It should be understood that the feature illustrated and described herein is intended as an example only and a feature 46 and opening 48 having any configuration are within the scope of the disclosure.

The locking module 40 additionally includes an engagement member 50 movable relative to the body 22 and keybox 30. The engagement member 50 engages a portion of the locking member 42 to transform the locking member 42 between the first locked position and the second unlocked position. In the illustrated non-limiting embodiment, the engagement member 50 includes a link having one or more protrusions 52 pinned to one or more protrusions 54 extending from the locking member 42. However, it should understood that any type of engagement member 50 configured to cooperate with the locking member 42 is contemplated herein.

The engagement member 50 is configured to move in response to operation of a mechanism 56, operably coupled to the engagement member 50. As shown, the mechanism 56 includes a drive plate 58 having a post 60 at least partially received within a corresponding opening (not shown) of the engagement member 50. The mechanism 56 is moved generally linearly to apply a vertical force to the engagement member 50. In an embodiment, the mechanism 56 includes a biasing member 62, such as a coil spring for example, configured to bias the drive plate 58 to a default position, away from the engagement member 50. The mechanism 56 for moving the engagement member 50 may be mechanically operated by a user, or alternatively, may include an electromechanical mechanism, such as a motor, solenoid, or a piezoelectric device for example, directly or indirectly coupled to the engagement member 50. In such embodiments, the mechanism 56 may be operable in response to an electrical input, such as generated by a code entered via a key pad or upon detection of an identification device, such as an RFID tag for example, having acceptable credentials.

In operation, a user provides an input to operate the mechanism 56 associated with the engagement member 50. In response to the input, the mechanism 56 causes the engagement member 50 to translate within a plane. As a result of the connection between the engagement member 50 and the locking member 42, the linear movement of the engagement member 50 causes the locking member 42 to rotate about its axis. The axis of the locking member 42 is oriented generally parallel to the plane within which the engagement member 50 is configured to translate. As the locking member 42 rotates about its axis, the locking member 42 transitions from a locked position to an unlocked position, thereby allowing the keybox 30 to translate relative to the locking module 40 and the body 22.

To reconnect the keybox 30 to the body 22, the feature 46 is aligned with and received within the opening. The mechanism 56 is operated to translate the engagement member 50 in an opposite direction, causing the locking member 42 to rotate from the unlocked position to the locked position. Initiation of this operation of the mechanism 58 may occur once the keybox 30 is fully inserted, or alternatively, may occur in response to a switch (not shown) activated as the keybox 30 is slidably inserted into the body 22. In the event that the user is not an authorized user, the drive plate 58 will move relative to the engagement member 50, but the engagement member 50 will not translate in response to the movement of the drive plate 58. Rather, the biasing member 62 will compress and bias the drive plate 58 back to its original position.

The locking module 40 illustrated and described herein has a simplified configuration resulting in a reduced cost. Further, the compact design of the locking module 40 eliminates the required space within the keybox 30 and body 22.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed:

1. A locking module for selectively coupling a first component and a second component of a lockable device comprising:

a locking member rotatable about an axis between an unlocked position and a locked position, said axis being arranged within a plane defined by movement of the second component relative to the first component; and an engagement member associated with said locking member, said engagement member being connected to said locking member in both said unlocked position and said locked position, wherein translation of said engagement member drives rotation of said locking member between said locked position and said unlocked position to selectively decouple said locking member from the second component.

2. The locking module of claim 1, wherein the locking member further comprises a feature formed therein, the feature being receivable within an opening of the second component when the locking member is in the unlocked position.

3. The locking module of claim 2, wherein said feature is received within said opening via a clearance fit when said locking member is in said unlocked position.

4. The locking module of claim 2, wherein said feature is not receivable within said opening when said locking member is in said locked position.

5. The locking module of claim 1, wherein said locking member is mounted within said second component.

6. The locking module of claim 1, wherein said engagement member includes one or more protrusions pinned to a portion of said locking member.

7. The locking module of claim 1, wherein said locking member is rotated 90 degrees about said axis between said unlocked position and said locked position.

8. The locking module of claim 1, further comprising a mechanism associated with said engagement member, said mechanism being configured to translate said engagement member within a plane.

9. The locking module of claim 8, wherein said mechanism further comprises:

a drive plate configured to apply a force to said engagement member; and a biasing member associated with said drive plate, said biasing member being configured to bias the drive plate away from the engagement member.

10. The locking module of claim 8, wherein said mechanism is a mechanical mechanism that operates the locking member in response to a user input.

11. The locking module of claim 8, wherein said mechanism is an electromechanical mechanism that operates the locking member in response to a user input.

12. The locking module of claim 8, wherein the locking module is applied to a lockbox such that first component is a body of the lockbox and the second component is a keybox.

13. The locking module of claim 8, wherein the locking module is applied to a lockbox such that first component is body of the lockbox and the second component is a shackle.

14. A method of operating a locking module of a lockable device comprising:

operating a mechanism in response to a user input;

translating an engagement member within a plane; and rotating a locking member coupled to said engagement member about an axis of rotation between a first position and a second position, said locking member including a feature selectively receivable within an opening of a movable component of the lockable device, wherein said engagement member is connected to said locking member in both said first position and said second position and said movable component is movable within a plane, said axis being arranged within said plane.

15. The method of claim 14, wherein said feature is receivable within said opening when said locking member is in said second position.

16. The method of claim 14, wherein said feature has a contour complementary to said opening when said locking member is in said second position.

17. The method of claim 14, wherein said feature is not receivable within said opening when said locking member is in said first position.

18. The method of claim 14, further comprising rotating said locking member about said axis between said second position and said first position to selectively couple said movable component to the lockable device.

* * * * *